United States Patent [19]

D'Aloia

[11] Patent Number: 4,643,430

[45] Date of Patent: Feb. 17, 1987

[54] TRUCKING BUSINESS—SIMULATION GAME

[76] Inventor: Valerio C. D'Aloia, 25 Third St., Edison, N.J. 08837

[21] Appl. No.: 719,059

[22] Filed: Apr. 2, 1985

[51] Int. Cl.[4] ..... A63F 3/00

[52] U.S. Cl. ..... 273/252; 273/290

[58] Field of Search ..... 273/243, 251, 252, 254, 273/256, 248, 249

[56] References Cited

U.S. PATENT DOCUMENTS

| | | | |
|---|---|---|---|
| 3,656,757 | 4/1972 | Carroll | 273/243 |
| 3,765,680 | 10/1973 | Paraskevas | 273/254 |
| 3,990,707 | 11/1976 | Terilli | 273/256 |
| 4,063,735 | 12/1977 | Wendel | 273/252 |
| 4,067,579 | 1/1978 | Boofer | 273/254 |
| 4,109,917 | 8/1978 | Hatcher | 273/254 |
| 4,134,591 | 1/1979 | Brooks | 273/252 |
| 4,283,059 | 8/1981 | Beeder | 273/256 X |
| 4,426,084 | 1/1984 | Michel | 273/254 |

FOREIGN PATENT DOCUMENTS

| | | | |
|---|---|---|---|
| 645661 | 11/1950 | United Kingdom | 273/251 |

*Primary Examiner*—Richard C. Pinkham
*Assistant Examiner*—Matthew L. Schneider
*Attorney, Agent, or Firm*—Karl F. Milde, Jr.

[57] ABSTRACT

A game is disclosed which simulates for each player the operation of a trucking enterprise. The game includes a number of miniature truck-like playing pieces each having a truck body with a cargo bay for carrying a miniature load. The game also includes a number of miniature cargo pieces which may be placed in and carried by the truck-like playing pieces. The game is played on a playing board having a predetermined travel path represented by a road which traverses a map of the continental United States. Dice are used by each player to advance the players' truck-like pieces along the travel path to pick up, carry and discharge cargo pieces at positions on the board marked by selectively placeable miniature trucking terminals.

20 Claims, 8 Drawing Figures

TRUCKING BUSINESS—SIMULATION GAME

BACKGROUND OF THE INVENTION

The present invention relates generally to board games and, more particularly, to a trucking business-simulation game for two or more players in which each player operates a trucking company in competition with other players.

A number of games are known which simulate aspects of the trucking industry. The U.S. Pat. No. 4,109,917 discloses a trucking game which simulates Citizens Band Radio (CB) communications during play. The game includes (1) a game board comprising a map of the continental United States with selected highway routes, and (2) tokens in the shape of miniature trucks for marking the progress of the players as they sequentially traverse the highway routes on the board. The game also includes a miniature police automobile simulating "Smokey": a policeman.

The U.S. Pat. No. 4,426,084 discloses a trucking simulation game which also comprises a playing board and a truck-like playing piece for each player. The playing board, in this case, has a single, predetermined travel path which is constituted by a plurality of playing spaces along which each truck-like playing piece is advanced during play.

Neither of these two games effectively simulates the operations of real-world trucking companies. The game disclosed in the U.S. Pat. No. 4,109,917 does not provide for the transportation of cargo of various types from one point on the board to another by means of the tokens. Instead, a set of "load cards" are used to determine the origin and destination terminal of each shipment, the type of freight hauled and the "ordinary" and "convoy" rates received when the load is delivered.

The U.S. Pat. No. 4,426,084 is considerably more complicated in that the rules of the game provide for buying and selling of goods at different locations along the travel path. Like the U.S. Pat. No. 4,109,917, the truck-like playing pieces are not used for transporting the goods. Rather, the goods are simulated by "truck load cards" which are used together with "load instruction cards" to represent the different goods to be considered loaded on, and carried by the respective playing pieces.

SUMMARY OF THE INVENTION

It is an object of the present invention to provide an improved trucking business-simulation game whereby specific goods of different value may be actually transported across the game board by means of miniature trucks.

It is a further object of the present invention to provide a game for two or more players which simulates competitive trucking companies with terminals in a visually exciting and true-to-life manner.

These objects, as well as other objects which will become apparent from the discussion that follows, are achieved, according to the invention, by providing a game which includes a number of first playing pieces, each comprising a miniature truck having a truck body with a cargo bay for carrying a miniature load. These first playing pieces are marked with the insignia or color of at least two different trucking companies so that each player may purchase and operate trucks associated with his own trucking company.

To effectively simulate the transport of goods, there is also provided a number of second playing pieces, each having the shape of miniature cargo which may be carried by one of the first playing pieces (trucks). These second playing pieces are designated in some way to indicate cargo of different monetary value.

The game also comprises a playing board having at least one predetermined travel path constituted by a plurality of playing spaces along which the first playing pieces may be advanced. In a preferred embodiment the predetermined travel path is represented by a road which traverses a map of the continental U.S. Random chance devices, such as a dye or dice, are used by each player for indicating the number of playing spaces that the player may advance a first playing piece along the travel path during each individual turn.

The game also comprises a number of third playing pieces, each having the shape of a miniature building. These playing pieces may be placed by the players at designated points on the game board along the travel path to represent trucking terminals or warehouses.

According to the invention, each player operates a separate trucking company in a manner which simulates, as closely as possible, a real-world trucking enterprise. Each trucking company has its own "fleet" of one, and eventually two or more trucks which may be purchased by the player (owner-operator of the trucking company) and used to transport goods (cargo) from place to place and thus earn revenue. The "first" playing pieces (miniature trucks) are thus moved along the travel path on the game board to pick up and discharge "second" playing pieces (miniature cargo) at designated playing spaces along the travel path. These second playing pieces may either be transferred from truck to truck at the trucking company terminals or warehouses, or they may be picked up or discharged at points on the board.

Realism is therefore added to the trucking game by actually, physically loading each truck, transporting the load and physically unloading the truck at its destination.

For a full understanding of the present invention, reference should now be made to the following detailed description of the preferred embodiment of the invention and to the accompanying drawings.

DESCRIPTION OF THE PREFERRED EMBODIMENT

The preferred embodiment of the present invention will now be described with reference to FIGS. 1–6 of the drawings.

Figure 1:
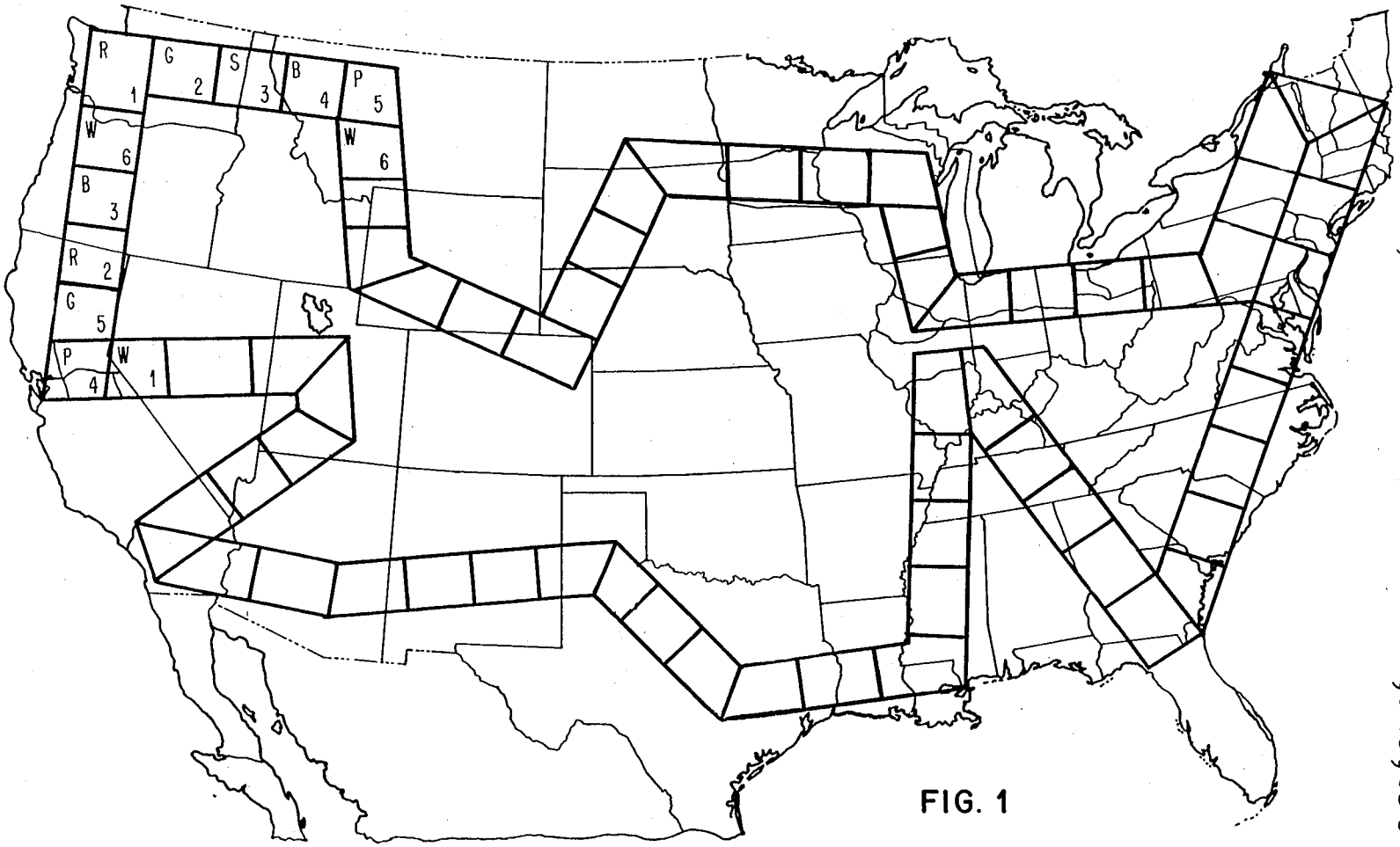
FIG. 1 is a top plan view of a playing board for use with the game according to the invention.

FIG. 1 illustrates a playing board comprising a map of the U.S. which may show major cities, major industries and/or popular physical land marks in each area, region or state.

Running through the map of the U.S. is a highway or travel path forming a single circuitous route. This travel path is formed of connected playing spaces (squares), each marked with one of six different colors (e.g. red, gold, silver, black, purple and white as indicated by the letters R, G, S, B, P and W, respectively) arranged in random order. In each colored square is a number from 1 to 6, also arranged in random order as illustrated in the Northwest section of highway. Both the colors and numbers are used to determine the revenue a player may receive when his truck lands on a particular square.

Each color appears approximately twelve times, so that there are, for example, two reds with a number one, two reds with a number two, and so on with each color.

Figure 2:
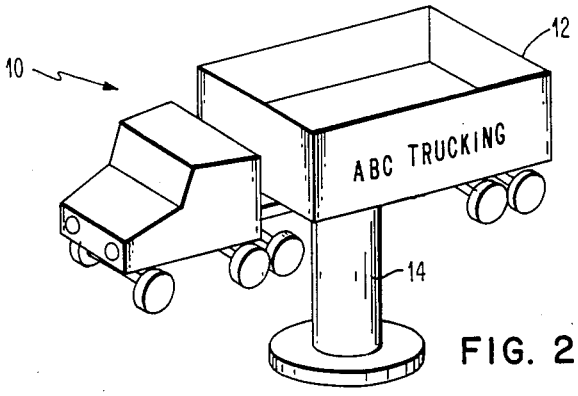
FIG. 2 is a perspective view of a first playing piece for use with the game according to the invention.

FIG. 2 shows a "first" playing piece in the shape of a miniature truck 10. The truck has a truck body 12 which forms a container, open at the top, for carrying a load. The truck is mounted on a small pedestal 14 for convenience in moving about the playing board.

As may be seen, the truck is marked with the name of a trucking company; namely, "ABC Trucking". Alternatively, the trucks for a particular trucking company may be all the same color. To play the game, it is necessary that there be at least two trucks for each trucking company (although each player starts the game with only one truck) and that there be one trucking company for each player. Thus, for six players, there must be a minimum of twelve miniature trucks as playing pieces (six sets of two), with each set having a different color or company marking for identification.

Figure 3A:
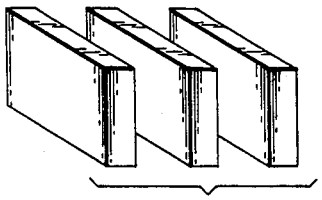
FIGS. 3*a*, 3*b* and 3*c* are perspective views of second playing pieces for use with the game according to the invention.
Figure 3B:
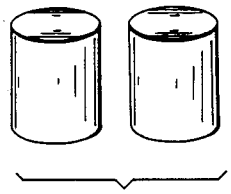
Figure 3C:
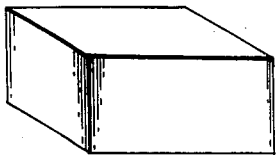
Figure 4:
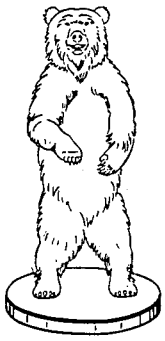
FIG. 4 is a perspective view of a fourth playing piece for use with the game according to the invention.
Figure 5:
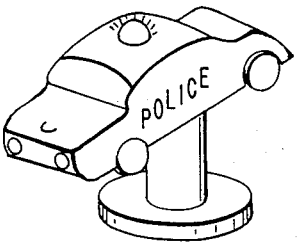
FIG. 5 is a perspective view of a fifth playing piece for use with the game according to the invention.

According to the invention, an actual load is placed on the miniature truck 10 during play. FIGS. 3*a*, 3*b* and 3*c* illustrate three examples of "second" playing pieces which may be used as cargo for the first playing pieces (trucks).

The cargo pieces shown in FIG. 3*a* have a flat rectangular shape. This shape is advantageous since a relatively large number of such pieces may be loaded into each truck.

FIGS. 3*b* and 3*c* illustrate cargo pieces as cylinders and a rectangular block, respectively. These cargo pieces may be so large that only one may be transported at a time in the truck body 12 or they may be sufficiently small to permit loading of several pieces.

Preferably, the cargo pieces are marked with a plurality of colors (e.g. colors that match the squares on the playing board). In this way, the cargo pieces of different shape and colors may represent various types of freight, each having a different monetary value.

Also required for the game is a random element such as a die or dice.

In the preferred embodiment of the game, there are three dice: two red dice and one die which has three blue sides and three yellow sides.

To add realism the game also includes third playing pieces, each having the shape of a building and representing a trucking terminal or warehouse. These third playing pieces, which carry the markings of the different trucking companies, are placed by the players at points of their chosing along the travel path on the game board.

There also are "fourth" and "fifth" playing pieces in the shape of a bear (FIG. 4) and a police (highway patrol) car (FIG. 5) respectively which can roam the travel path and encounter (land on the same squares as) the truck playing pieces, the trucking terminals and warehouses. Preferably, the truck playing pieces move clockwise around the circuitous travel path whereas the bear and police playing pieces move counterclockwise. When the bear and/or police encounter a truck, terminal or warehouse, the player must pick a "chance card" which indicates a particular consequence of this encounter.

Figure 6:
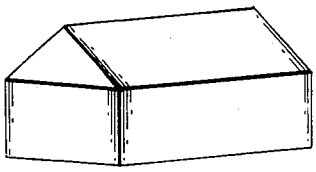
FIG. 6 is a perspective view of a third playing piece for use with the game according to the invention.

FIG. 6 shows a miniature building i.e. a "third" playing piece which may serve in the game as a main trucking terminal, subterminal or warehouse. Like the truck playing pieces, these terminals are marked, for example by colors, to identify their associated trucking companies. In the preferred embodiment of the game, for each trucking company there are a main terminal, fifteen small (sub)terminals and four warehouses.

The game also includes different sets of "chance cards" which may be picked up and acted on during the game. For example, the game may include "trucker's" chance cards indicating routine events which affect the operation of a player's trucking company; "bear" chance cards and "police" chance cards, indicating unusual events which affect a player's fortune; "loan cards" indicating the amounts of loans which may be obtained by a player in need of additional cash; "equity cards" indicating the amount of equity in a trucking company held by a player; and "dividend cards" indicating the amount of a dividend to be issued to a player by his trucking company.

Finally, the game may include paper bills of exchange or "play money" of various denominations such as $50.00, $100.00, $500.00, $1,000.00, $5,000.00 and $10,000.00. The money represented by these bills of exchange is utilized in playing the game to simulate the operation of a real-world trucking enterprise.

Game Operation:

At the start of a game, each player is given two trucks and one main terminal of the same company, plus $10,000.00 in bills of various denominations.

All players place their main terminal on any square on the board and start their trucks from there. Players roll the dice (three) for high first roll. The first high goes first, second high second, etc. The bear and police (highway patrol) car start from the first high player's square and go counter-clockwise on the board. All the players' trucks proceed clockwise. Either the bear or the police (but not both) is moved on every player's roll of the dice after the player first moves his truck.

The object of the game is to move one's trucks with a maximum of colored loading pieces, six of any combination of colors, to their destination (around board clockwise and back to main terminal) to collect full revenue.

Each player in order casts dice for movement of (1) one of his trucks and (2) either the bear or the police car. The truck's movement is the total count on the two red dice. The bear's movement is the value on the yellow sides of the extra die. The police car's movement is the value on the blue sides of the extra die. As an empty truck starts out and stops on the colored squares, it picks up those colored cargo pieces until a load of six pieces is reached. With each cargo piece picked up, the player's truck is eligible to be paid revenue according to the truck load on the following turn. Revenue is paid after a cargo piece is first picked up, when the truck lands on a square with the color of a carried cargo piece (Example: Player rolls dice, truck moves to a colored square (gold) and a gold cargo piece is put on board that truck. No revenue is paid as the first gold piece is loaded. When the player rolls any subsequent time and the truck lands on a gold square, revenue is paid.)

On the colored squares are numbers from 1 through 6 giving a value to each square. When a truck lands on a square that matches in color at least one of the loaded pieces on board that truck, the player is awarded revenue. The number in the square times the amount of matching colored cargo pieces (each cargo piece having a fixed value) is the computed revenue.

Each player continues in turn to roll dice to move his truck or trucks until he reaches his main terminal. At that point the player collects revenue in the amount of six times the value of each cargo piece on board that truck.

At this time the truck is in play again and placed empty on the square adjacent the main terminal for another trip. All other pieces remain on the board at their places.

After the first truck completes its first trip, a player can start his second truck. When this player has two trucks on the board, he has the option of moving either truck but only one truck can be moved with each player's roll of the dice.

When a truck lands on a square which does not match any cargo piece on board that truck, the player pays a road use tax (even if he has a terminal or warehouse on that square). Trucks may carry any combination of colored cargo pieces to a destination.

When the bear playing piece lands on a square which is occupied by a terminal or warehouse, that player who owns the terminal or warehouse must pick a penalty card from the deck marked "B".

Similarly, when the police car playing piece lands on a square which is occupied by a truck, that player who owns the truck must pick a penalty card from the deck marked "P".

At the final destination a terminal may be purchased and then placed on any square on the board even though another player's terminal or warehouse may be on the same square.

Terminals can be made into three different sizes by just adding terminal blocks.

A—One terminal on square: double payoff.

B—Two terminals on square: triple payoff.

C—Three terminals on square: quadruple payoff.

Once terminals are placed on the board they cannot be moved.

When the bear lands on square with a terminal of A, B, or C size, that player owning the terminal must pick a card from deck "B". At these terminals (A, B or C) the player whose truck lands on this terminal may exchange one of the cargo pieces on that truck.

At his final destination, a player is awarded a dividend card which is paid whenever a player lands on a square with one of his warehouses. He is also awarded a second roll of the dice.

Warehouses which are in a matching color to subterminals and main terminals may be purchased when a truck completes a trip. The option to buy a warehouse is with the player. This may be done when a player has at least five subterminals on the board. After ten subterminals are on the board the player may purchase another warehouse.

A warehouse may be placed anywhere on the board along the path of travel.

When a warehouse and subterminals are together on same square, the player collects for both the warehouse and subterminals. When the bear lands on that square, it is counted as only one penalty; i.e., only one "B" card is picked.

When a player is holding a dividend card and his truck lands on his warehouse (alone) or his warehouse and subterminal, he is awarded all the revenue due him, such as his truck load revenue with the multiples made possible by the subterminals, plus the dividend. The player is then also entitled to another roll of the dice.

There has thus been shown and described a novel trucking business-simulation game which fulfills all the objects and advantages thought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are intended to be covered by the claims which follow.

What is claimed is:

1. A game for two or more players which simulates competitive trucking enterprises, comprising:

(a) a plurality of first playing pieces, each having the shape of a miniature truck with a truck body providing a cargo bay forming a container, open at the top for carrying a miniature load, said plurality of first playing pieces having markings of at least two different trucking companies, with at least two of said first playing pieces being associated with each trucking company;

(b) a plurality of second playing pieces, each having the shape of miniature cargo of a size suitable for conveyance by one of said first playing pieces, individual ones of said second playing pieces being different so as to represent cargo of different monetary value;

(c) a playing board having at least one predetermined travel path constituted by a plurality of playing spaces along which the first playing pieces may be advanced;

(d) a plurality of third playing pieces, each having the shape of a miniature building and representing a trucking terminal, each of said third playing pieces, respectively, carrying the markings of one of said different trucking companies, said third playing pieces being adapted to be placed at designated points on said playing board along said predetermined travel path; and (e) random chance means for indicating to each player the number of playing spaces that such player may advance a first playing piece along said travel path during each individual turn, whereby each player simulates the operation of a trucking enterprise by loading, carrying and unloading said second playing pieces at the positions of said third playing pieces, and at other positions along said travel path using said first playing pieces to transport said second playing pieces along said predetermined travel path.

2. The game as defined in claim 1, wherein said markings on said first playing pieces are colors, whereby each differeht trucking company is represented by a different color.

3. The game as defined in claim 1, wherein said markings on said first playing pieces are the names of trucking companies, whereby each different trucking company is identified by a different name.

4. The game as defined in claim 1, wherein at least some of said second playing pieces are flat rectangular shapes.

5. The game as defined in claim 1, wherein at least some of said second playing pieces are cylinders.

6. The game as defined in claim 1, wherein at least some of said second playing pieces are rectangular blocks.

7. The game as defined in claim 1, wherein said second playing pieces are each marked with a solid color, there being a plurality of colors for such playing pieces, each color representing a different monetary value.

8. The game as defined in claim 1, wherein said playing board has a single circuitous travel path.

9. The game as defined in claim 1, wherein at least some of said playing spaces on said playing board have digital numbers associated therewith, whereby said numbers may be used to add an additional random element to the game.

10. The game as defined in claim 1, wherein at least some of said playing spaces on said playing board have different colors associated therewith, whereby said colors may be used to add an additional random element to the game.

11. The game as defined in claim 1, wherein said random chance means includes at least one die.

12. The game as defined in claim 1, further comprising at least one fourth playing piece having the shape of a bear, whereby said fourth playing piece may be moved along said travel path on said playing board to add an additional random element to the game.

13. The game as defined in claim 12, further comprising a plurality of bear chance cards, each bear chance card indicating a particular consequence of an encounter by said fourth playing piece with a particular trucking company.

14. The game as defined in claim 1, further comprising at least one fifth playing piece having the shape of a police car, whereby said fifth playing piece may be moved along said travel path on said playing board to add an additional random element to the game.

15. The game as defined in claim 14, further comprising a plurality of police chance cards, each police chance card indicating a particular consequence of an encounter by said fifth playing piece with a player's trucking company.

16. The game as defined in claim 1, wherein there are a plurality of said third playing pieces marked for, and associated with each trucking company.

17. The game as defined in claim 1, further comprising a plurality of trucker's chance cards, each trucker's chance card indicating an event which affects the operation of a player's trucking company.

18. The game as defined in claim 1, further comprising a plurality of loan cards, each loan card indicating the amount of a loan which may be obtained by a player for such player's trucking company.

19. The game as defined in claim 1, further comprising a plurality of trucking company equity cards, each equity card indicating the amount of equity in a trucking company held by a player.

20. The game as defined in claim 1, further comprising a plurality of trucking company dividend cards, each dividend card indicating the amount of a dividend to be issued to a player by the respective trucking company.

* * * * *